United States Patent [19]

Bliss

[11] 4,125,185

[45] Nov. 14, 1978

[54] DIVIDED DISPLAY CARTON AND BLANK THEREFOR

[75] Inventor: Robert A. Bliss, St. Paul, Minn.

[73] Assignee: Champion International Corporation, Stamford, Conn.

[21] Appl. No.: 789,492

[22] Filed: Apr. 21, 1977

[51] Int. Cl.[2] ..... B65D 5/50

[52] U.S. Cl. ..... 206/45.15; 206/45.11; 206/45.31; 206/426; 206/435; 229/27; 229/42

[58] Field of Search ..... 229/42, 27, 29 D; 206/45.11, 45.14, 45.15, 45.17, 45.31, 187, 191, 193, 197, 426, 434, 435, 430

[56] References Cited

U.S. PATENT DOCUMENTS

| | | | |
|---|---|---|---|
| 2,840,228 | 6/1958 | Takacs | 206/45.31 |
| 2,886,234 | 5/1959 | Toensmeier | 206/45.31 |
| 3,047,135 | 7/1962 | Miller | 229/42 |
| 3,166,229 | 1/1965 | Sherman et al. | 229/42 |
| 3,575,286 | 4/1971 | Rosenburg, Jr. | 206/45.14 |
| 3,680,687 | 8/1972 | D'Alessio | 206/45.14 |
| 3,685,640 | 8/1972 | Tolaas | 206/45.31 |
| 3,698,544 | 10/1972 | Growney | 206/45.14 |
| 3,780,931 | 12/1973 | Hanson | 229/27 |
| 3,835,987 | 9/1974 | Growney | 206/45.14 |
| 4,032,006 | 6/1977 | Cantarella et al. | 206/45.31 |

*Primary Examiner*—Stephen P. Garbe
*Assistant Examiner*—Bruce H. Bernstein
*Attorney, Agent, or Firm*—Evelyn M. Sommer

[57] ABSTRACT

A display carton is formed from an integral planar blank having panels which when folded form the carton and automatically divide the interior of the carton into a pair of longitudinal compartments having shelves for supporting and spacing a plurality of articles within the interior of each compartment above and below each shelf. The front wall of the carton is provided with a display opening for exposing the articles to view.

13 Claims, 8 Drawing Figures

DIVIDED DISPLAY CARTON AND BLANK THEREFOR

BACKGROUND OF THE INVENTION

1. Field of the Invention

This invention relates to a display carton and a blank for forming the same.

2. Description of the Prior Art

While the prior art is replete with cartons for displaying a variety of singular or plural articles and carton blanks for forming the same, such cartons usually do not contain integral shelves for automatically separating and supporting a plurality of stacked articles to be displayed in the carton. The present invention provides a single planar blank, which when folded, automatically provides individual compartments to separately house and support like articles; the compartments being formed with integral shelves comprising foldable portions of the blank.

SUMMARY OF THE INVENTION

In accordance with the invention, a planar blank is provided which has a central panel including a circular display window and transverse flaps which are foldable about horizontal fold lines between each flap and the central panel to form the top and bottom of the display carton. Extending laterally from each side of the central panel is a flap which is foldable about a vertical fold line to form opposite sides of the carton. Connected to each side flap by a fold line is a laterally extending extension flap, which overlap and are glued together to form the rear wall of the carton, opposite the central panel containing the circular display opening. One of the extension flaps includes a further laterally extending panel containing a semi-elliptical opening connected to the extension flap by a score line. A pair of tabs containing adhesive extend laterally from opposite ends of the extension panel adjacent the ends of the opening. When the extension panel is folded about its score line connection to the extension flap, it will assume a vertical position parallel to the extension flaps forming the side walls of the carton, automatically dividing the carton in half to provide a pair of adjacent compartments in the carton. The tabs are bent into a plane perpendicular to the extension panel and adhered to the front central panel to maintain the panels in assembled relation.

Each extension flap connected to the laterally extending side panels has a vertical and downwardly extending extension panel foldable about a transverse fold line. The foldable section includes a triangular section foldable under itself to reinforce the foldable section, which when bent to a position perpendicular to the vertical extension panel and when the panel is folded back upon itself into abutment with the lateral extension flap forming a portion of the rear of the carton, will provide a shelf dividing each vertically extending compartment formed within the interior of the carton in half. The triangular section also includes a foldable rectangular tab which can be adhesively connected to the downwardly extending extension flap when the flap is folded into abutment with the lateral extension flap, to retain the shelf in position.

With the blank folded into the configuration discussed above, four articles such as coffee mugs can be supported and displayed within the automatically divided and compartmentalized interior of the carton. A mug can be supported in each compartment on each shelf between the shelf and the top wall and between each shelf and the bottom wall of the carton. The semi-elliptical opening in the central divider wall formed by the laterally extending panel connected to one of the laterally extending flaps, provides an opening through which a mug handle may extend. The supported mugs will also be visible through the circular display window in the front central panel.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
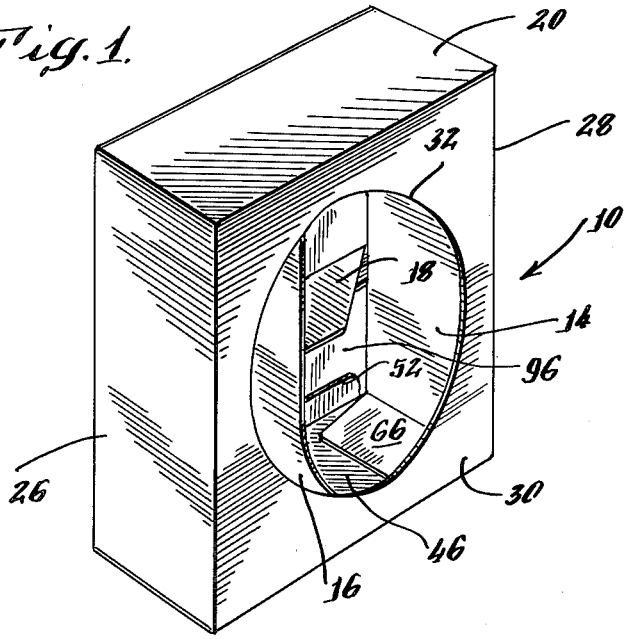
FIG. 1 is a perspective view of the assembled display carton of the present invention.
Figure 9:
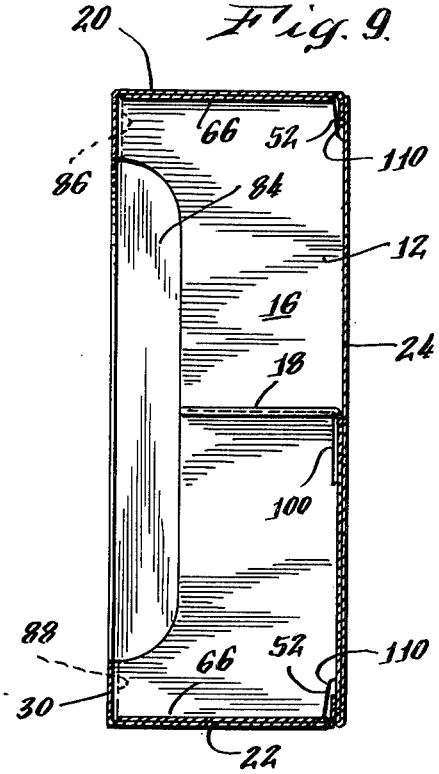
FIG. 9 is a cross-sectional view taken substantially along the plane indicated by line 9—9 of FIG. 8.

Referring now to the drawings in detail wherein like numerals indicate like elements throughout the several views, the display carton 10 of the present invention is used to support and display a plurality of articles, such as coffee mugs M, within the interior of carton 10.

Two of the mugs M are supported in a vertical compartment 12 or 14 formed by a central, upright divider wall 16. One of the two mugs M in each compartment 12 or 14 is supported on a substantially horizontal shelf 18 between the shelf and a top wall 20, while the other of the two mugs M in each compartment is supported on a bottom wall 22 of carton 10 between the bottom wall and the shelf 18. Each shelf 18 is disposed substantially midway between the top and bottom walls 20 and 22.

The carton construction 10 also includes a back wall 24, a pair of opposed, parallel side walls 26, 28 and a front wall panel 30 having a circular display window 32 revealing the interior of carton 10 to display the mugs M.

Figure 4:
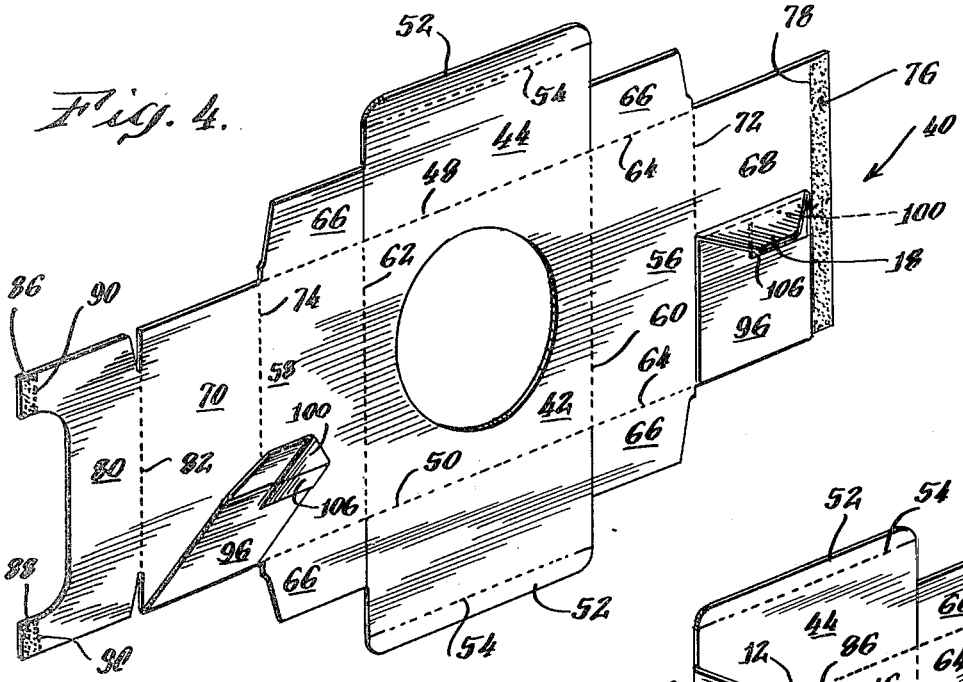
FIGS. 4 to 6, inclusive, are perspective views of the blank of FIG. 2 in various intermediate stages of being folded to form the carton of FIG. 1.
Figure 5:
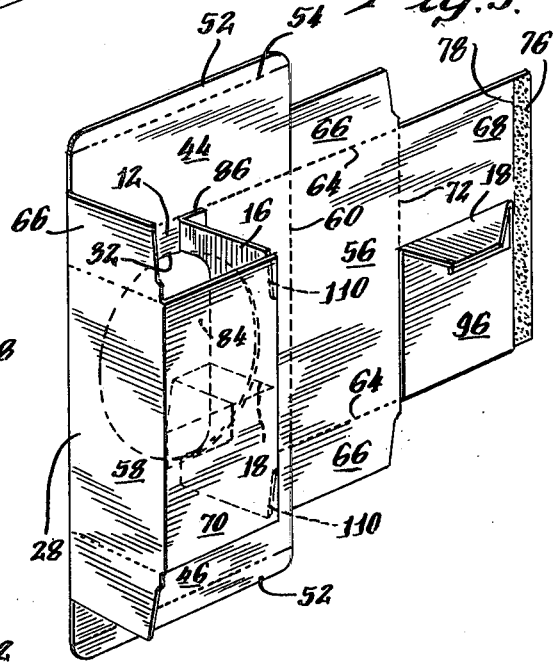
Figure 7:
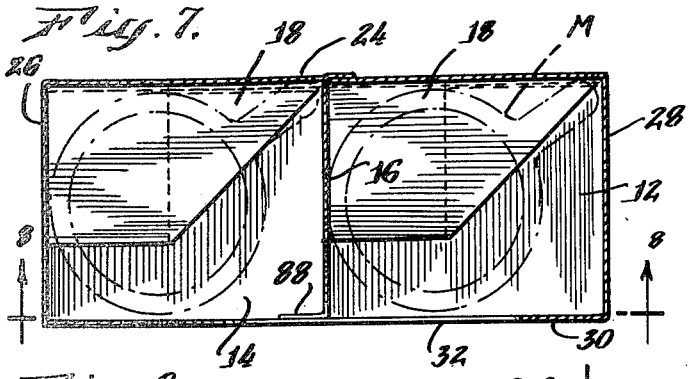
FIG. 7 is a transverse cross-sectional view through the carton of FIG. 1 as seen substantially along the plane indicated by line 7—7 of FIG. 8.
Figure 8:
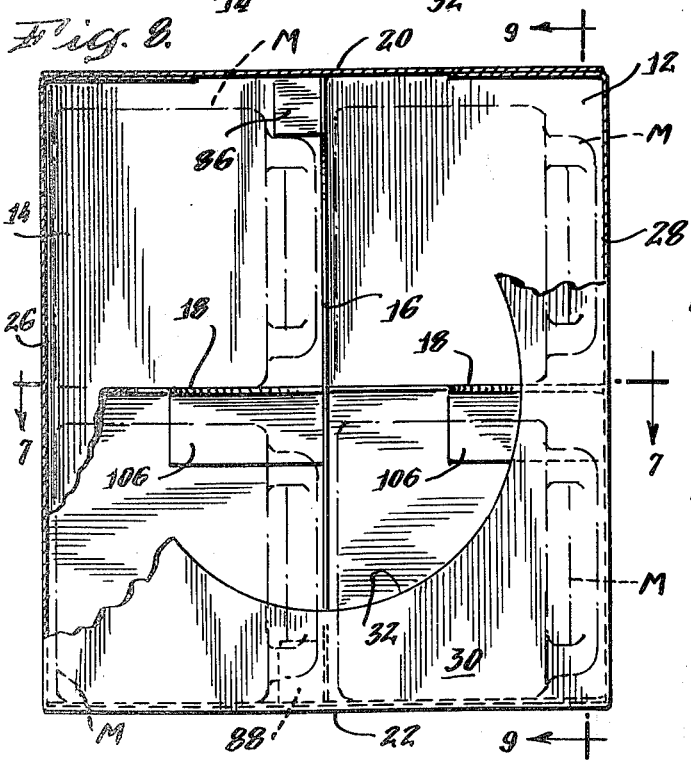
FIG. 8 is a cross-sectional view taken substantially along the plane indicated by line 8—8 of FIG. 7.
Figure 6:
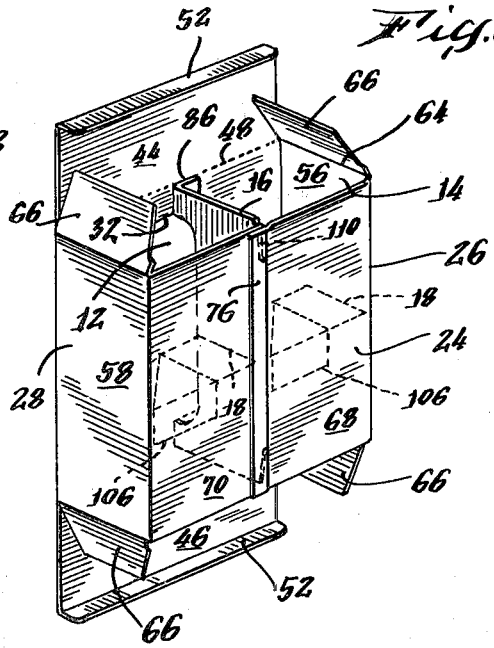

Carton 10 is formed from a single, integral, planar blank 40, folded as shown in FIGS. 4 to 6, inclusive.

Blank 40 is provided with a central panel 42 including precut circular display window 32. Upper and lower transverse flaps 44 and 46, respectively, are joined to central panel 42 by horizontal fold lines 48 and 50, respectively. A tuck flap 52 is joined by a fold line 54 to each of the upper and lower transverse flaps 44 and 46.

Extending laterally from each side of central panel 42 is a side flap 56 and 58, respectively, of equal width, joined to central panel 42 by a fold line 60 and 62, respectively. Joined to the top and bottom edges of each side flap 56 and 58 by a fold line 64 is an upper and lower extension flap 66.

Connected to side flaps 56 and 58, respectively, are lateral extension flaps 68 and 70 of equal width. Extension flap 68 is connected to side flap 56 by a fold line 72, while extension flap 70 is connected to side flap 56 by a fold line 74. A glue containing panel 76 is connected by a fold line 78 to the free side edge of extension flap 68, while an extension panel 80 is connected by a score line 82 to the free side edge of extension flap 70. Extension panel 80 includes a semi-elliptical opening 84 cut in its free lateral edge bounded by upper and lower tabs 86 and 88, respectively, bendable about a score line 90 between each tab 86, 88 and panel 80. Tabs 86 and 88 are provided with an adhesive surface 92 for a purpose to be described hereinafter.

Figure 3:
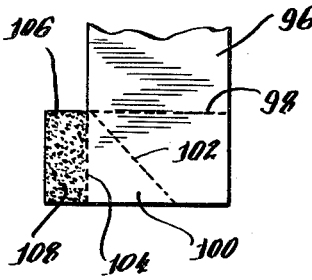
FIG. 3 is a back plan view of a portion of the blank of FIG. 2.
Figure 2:
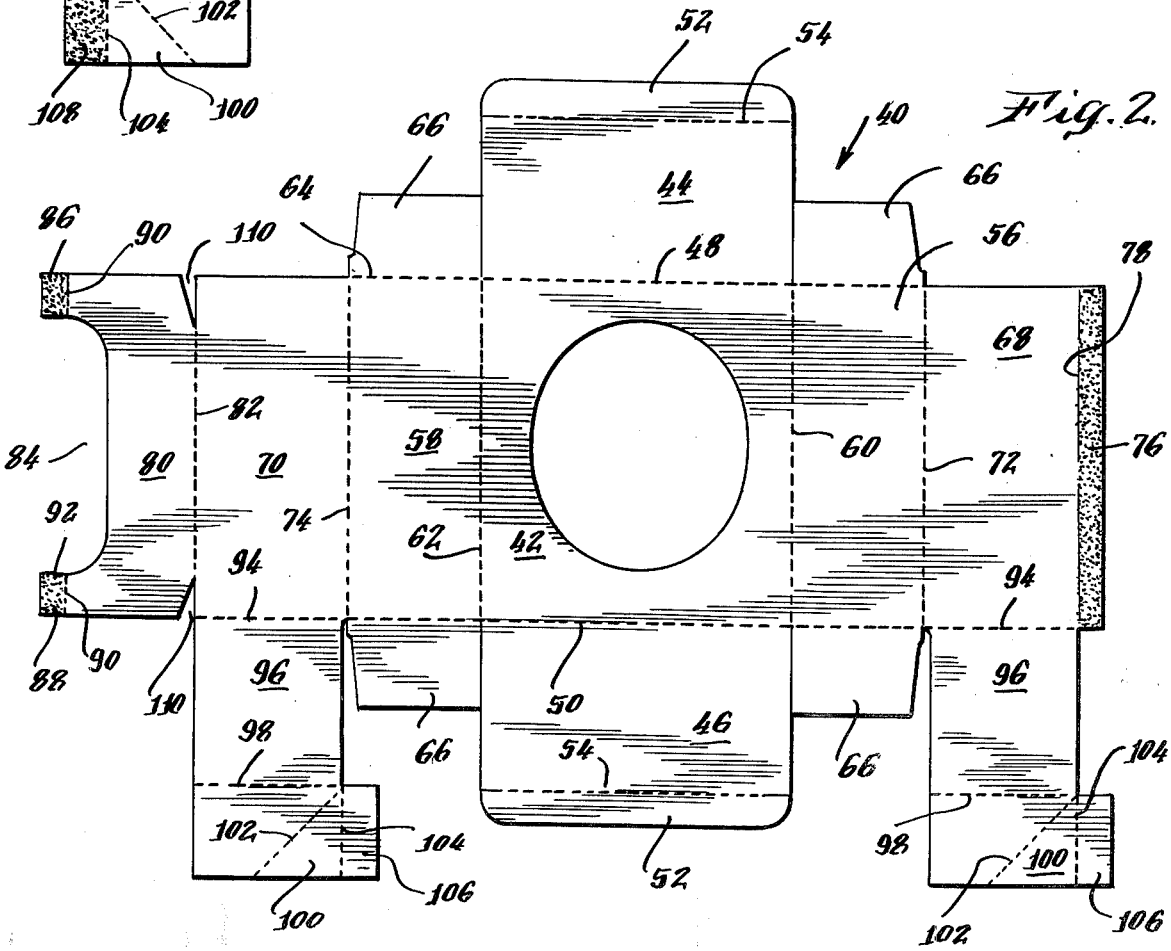
FIG. 2 is a top plan view of the blank used to form the carton of FIG. 1.

Connected by a fold line 94 to the bottom edge of each extension flap 68 and 70 is an identical, downwardly extending L-shaped panel 96. Each L-shaped panel 96 includes a horizontal score line 98 and a triangular section 100 bounded by score lines 102 and 104. Score line 104 also joins a rectangular tab 106 to panel 96. The rear surface of each tab 106 includes an adhesive layer 108 (FIG. 3).

FIGS. 4 to 6 illustrate the manner of folding blank 40 to construct carton 10.

First, each downwardly extending L-shaped panel 96 is folded upwardly about score line 94 until panel 96 abuts its associated extension flap 68 and 70. The lower portion of each panel 96 is then folded downwardly about score line 98 until the lower portion is at a 90° attitude with respect to the remainder of panel 96 and flaps 68 and 70 to form a shelf 18, as shown in FIG. 4. Each triangular section 100 is then folded downwardly about score line 102 until it abuts the lower surface of shelf 18, forming a double walled reinforcement for the shelf. Tab 104 is then bent upwardly along score line 104 until it abuts panel 96 and its adhesive surface 108 adhered to the panel 96. If desired, although not necessary, the opposite surface of panel 96 may be adhesively secured to extension flaps 68 and 70.

With shelves 18 formed, side flap 58 is folded 90° about fold line 62, extension flap 70 is folded 90° relative to side flap 58 about fold line 74, and extension panel 80 is folded 90° relative to extension flap 70 to form with half of central panel 42, compartment 12. Tabs 86 and 88 are then folded 90° back towards panel 80 and placed in abutment with the rear of central panel 42 and adhesively secured thereto. As shown in FIG. 5, side flap 58 becomes side wall 28 of carton 10, while panel 80 comprises central divider wall 16.

Then, side flap 56 is folded 90° about fold line 60, extension flap 68 is folded 90° relative to side flap 56 about fold line 72, forming with the other half of central panel 42, compartment 14. Panel 76 is overlapped with a portion of flap 70 and adhesively secured thereto, forming back wall 24 of carton 10, consisting of flaps 68 and 70.

The mugs M are then placed into compartments 12 and 14 from the open top and bottom of each compartment. The handles of the mugs M can be accommodated through semi-elliptical opening 84, if space for the mugs M within each compartment is at a premium. Further, the relief of divider wall 16 provided by opening 84 readily permits viewing of the articles through opening 14 from various angles.

To complete the carton construction 10, it is only necessary to fold extension flaps 66 90° about fold lines 64 so that they overly the top and bottom of open compartments 12 and 14. Transverse flaps 44 and 46 are then folded 90° about fold lines 48 and 50, respectively, to form top and bottom walls 20 and 22 of carton 10, respectively. Flaps 52 are then bent about fold lines 54 and inserted in a triangular recess 110, cut between the top and bottom of panel 80 and extension flap 70 in blank 40. This disposes flaps 52 between central divider 16 and back wall 24 to retain the carton 10 in assembled, closed condition, as shown in FIG. 1. Central panel 42, with display window 32, forms the front wall 30 of carton 10.

What is claimed as new is as follows:

1. A display carton comprising:

a front wall, a back wall, a pair of side walls joining said back wall to said front wall, a top wall, and a bottom wall, said top and bottom walls extending between said front and back walls, hinge means pivotably connecting said top and bottom walls to said front wall, said back wall being formed from a pair of flaps, each of said flaps being hingedly connected to a sidewall, one of said flaps overlapping the other and being adhesively secured to the other, a central divider wall hingedly connected to said overlapped one of said back wall flaps and folded to a position extending between said front and back walls generally parallel to said side walls dividing the interior of said carton between said side walls into a pair of compartments adapted to receive a plurality of articles therein, a shelf in each of said compartments hingedly connected to a panel which is hingedly connected to an edge of each of said back wall flaps and folded to a position extending between said front and back walls in a plane substantially perpendicular to said divider wall, said shelves being disposed substantially midway between said top and bottom walls and substantially parallel thereto, each shelf being adapted to support an article thereon in each of said compartments between said shelf and said top wall and to provide a divider for an article supported on said bottom wall between said bottom wall and said shelf, and a display opening cut in said front wall to expose the articles within each of said compartments to view.

2. The carton of claim 1 wherein said central divider wall includes a recess along one edge thereof opposite to said display opening.

3. The carton of claim 1 wherein said central divider wall includes a pair of tabs adhesively connecting said divider wall to the rear surface of said front wall.

4. The carton of claim 1 wherein each of said shelves includes a reinforcing portion bent back upon itself.

5. The carbon of claim 4 wherein said reinforcing portion includes a tab adhesively connected to the rear surface of said front wall.

6. The carton of claim 1 wherein said side walls are hingedly connected to opposite lateral edges of said front wall.

7. The carton of claim 1 wherein said central divider wall includes a top and bottom recess cut therein adjacent one of said front and back walls, and said top and bottom walls include a tuck flap insertable within said recess.

8. A planar blank for forming a display carton comprising a central panel having an opening cut therein, said central panel including a pair of parallel lateral edges and a pair of parallel transverse edges, a pair of side panels of identical height and width connected by a fold line to said parallel lateral edges of said central panel, an upper and lower transverse panel of identical height and width, one of said transverse panels being connected to one of the transverse edges of said central panel by a fold line and the other of said transverse panels being connected by a fold line to the other of said transverse edges, a laterally extending side panel extension flap of identical height and width connected by a fold line to a lateral edge of each of said side panels, an extension panel connected by a fold line to a lateral edge of one of said side panel extension flaps, said extension panel including a pair of tabs at opposite ends thereof bendable about a fold line substantially parallel to the fold line connecting said extension panel to the lateral edge of said one side panel extension flap, each of said side panel extension flaps includes an identical downwardly extending L-shaped panel connected to a lower transverse edge of each of said side panel extension flaps, a transverse fold line parallel to the lower transverse edge of its associated side panel extension flap, a lower triangular section defined by a pair of fold lines, and a laterally extending tab connected to one of the fold lines of said triangular section.

9. The blank of claim 8 wherein each of said tabs includes an adhesive surface.

10. The blank of claim 9 including a second extension panel connected by a fold line to a lateral edge of the other of said side panel extension flaps, said second extension panel including an adhesive surface.

11. The blank of claim 8 wherein a surface of each of said laterally extending tabs includes an adhesive surface.

12. The blank of claim 8 wherein said extension panel includes a semi-elliptical opening cut therein between said tabs.

13. The blank of claim 8 wherein said extension panel includes a top and bottom recess cut therein along the fold line joining said extension panel to the lateral edge of said one side panel extension flap, and said upper and lower transverse panels include a flap joined by a transverse fold line to a free transverse edge of each of said upper and lower transverse panels.

* * * * *